United States Patent [19]

Douglass et al.

[11] 4,288,920

[45] Sep. 15, 1981

[54] SHAVING SYSTEM WITH PIVOTALLY MOUNTED RAZOR CARTRIDGE

[75] Inventors: Paul W. Douglass, Winchester; Robert A. Trotta, Winthrop, both of Mass.

[73] Assignee: The Gillette Company, Boston, Mass.

[21] Appl. No.: 93,692

[22] Filed: Nov. 13, 1979

[51] Int. Cl.[3] ..... B26B 21/14

[52] U.S. Cl. ..... 30/47; 30/89

[58] Field of Search ..... 30/47, 50, 57, 87, 89

[56] References Cited

U.S. PATENT DOCUMENTS

| | | | |
|---|---|---|---|
| 2,311,913 | 2/1943 | Testi | 30/62 |
| 2,915,817 | 12/1959 | Peck | 30/48 |
| 3,657,811 | 4/1972 | Nissen | 30/77 |
| 3,685,150 | 8/1972 | Risher | 30/89 |
| 3,740,841 | 6/1973 | Risher | 30/57 |
| 3,816,912 | 6/1994 | Glaberson | 30/47 |
| 3,816,916 | 6/1974 | Kuhnl | 30/47 |
| 3,871,077 | 3/1975 | Nissen | 30/63 |
| 3,950,848 | 4/1976 | Goldstein | 30/47 |
| 3,950,849 | 4/1976 | Perry | 30/47 |
| 4,227,302 | 10/1980 | Torrance | 30/47 |

*Primary Examiner*—Gary L. Smith

*Attorney, Agent, or Firm*—Scott R. Foster

[57] ABSTRACT

A shaving system including a handle and a blade assembly, the handle having first and second connecting portions extending from an end thereof, the blade assembly comprising a body portion having blade apparatus permanently fixed therein, a first blade assembly connecting portion pivotally engaged with the first handle connecting portion, and a second blade assembly connecting portion fixedly connected to the second handle connecting portion to facilitate dynamic change of shaving geometry during a shaving operation.

9 Claims, 11 Drawing Figures

SHAVING SYSTEM WITH PIVOTALLY MOUNTED RAZOR CARTRIDGE

BACKGROUND OF THE INVENTION

1. Field of the Invention

This invention relates to wet shaving systems, and is directed more particularly to such systems in which a replaceable blade assembly is moveably attached to a handle.

2. Description of the Prior Art

Safety razors conventionally comprise a guard member and a cap member between which, in use, a disposable razor blade is sandwiched, and a handle, the guard member, the cap member, and the handle being fixed relative to one another. The latter feature is present in the conventional one-piece and "three-piece" razors designed to take disposable double-edged blades. Safety razors have recently appeared on the market which comprise, instead of disposable razor blades, a disposable razor blade assembly, or head, having a guard member, one or more blades, and a cap member held rigidly together. The disposable razor blade assembly is rigidly attached to a handle so that the razor edges are at a fixed angular attitude relative to the handle. The blade assembly is replaced as a whole when the razor cutting edge (or edges) becomes dull.

Continuing efforts are being made to improve the shaving characteristics of such implements and/or to accommodate individual preferences. A factor in shaving efficiency and effectiveness is the orientation of the active components of the shaving system relative to the skin surface being shaved. The surface frequently has undulations or is in a relatively inaccessible or awkward area to reach and the shaving action is reduced in efficiency because the relationship of the active element to the skin surface being shaved significantly departs from the optimum value. Razors in which there is a fixed relationship between the shaving unit and the handle call for considerable dexterity on the part of the user and substantial changes in the disposition of the handle in order to maintain the shaving unit at its optimum attitude on the shaver's face, particularly when negotiating areas, such as the jaw line, where there are gross changes in facial contours.

Recent improvements have resulted in a shaving system as described in U.S. Pat. No. 4,026,016 in which a blade assembly is pivotally mounted on a handle such that the blade assembly is movable relative to the grip portion of the handle in a manner conformable or responsive to the surface of the skin being shaved. While such shaving system has been imminently successful from a commercial standpoint, there are shavers who prefer the stability of a blade assembly fixed to a handle, as opposed to a freely pivotable blade assembly.

SUMMARY OF THE INVENTION

An object of the present invention is to provide a shaving system in which a replaceable blade assembly is movably mounted on a razor handle.

A further object of the invention is to provide such a system in which a first portion of the blade assembly is pivotally attached to the handle and a second portion of the blade assembly is fixedly connected to the handle, the first and second blade assembly portions being themselves pivotally joined, to facilitate change of shaving geometry during a shaving operation.

With the above and other objects in view, as will hereinafter appear, a feature of the present invention is the provision of a shaving system including a handle and a blade assembly, the handle having first and second connecting portions extending from an end thereof, the blade assembly having a first body portion having thereon a first blade assembly connecting means and a second body portion having thereon a second blade assembly connecting means, the first blade assembly connecting means being pivotally connected to the first handle connecting portion, and the second blade assembly connecting means being fixedly connected to the second handle connecting portion.

In accordance with a further feature of the invention, the blade assembly first body portion is pivotally joined to the blade assembly second body portion.

The above and other features of the invention, including various novel details of construction and combinations of parts, will now be more particularly described with reference to the accompanying drawings and pointed out in the claims. It will be understood that the particular system embodying the invention is shown by way of illustration only and not as a limitation of the invention. The principles and features of this invention may be employed in various and numerous embodiments without departing from the scopes of the invention.

BRIEF DESCRIPTION OF THE DRAWINGS

Reference is made to the accompanying drawings in which is shown an illustrative embodiment of the invention from which its novel features and advantages will be apparent.

In the drawings.

DESCRIPTION OF THE PREFERRED EMBODIMENT

Figure 1:
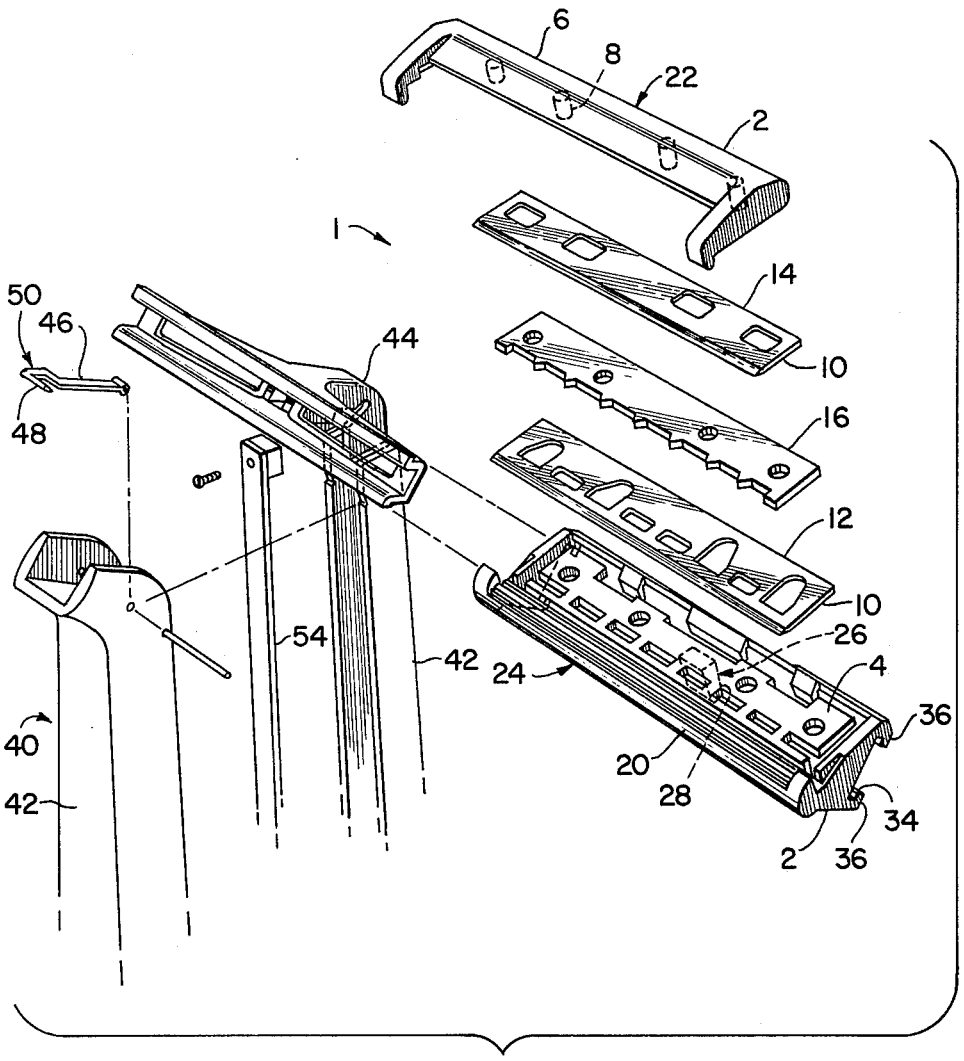
FIG. 1 is an exploded perspective view of a shaving system illustrative of the invention.
Figure 2:
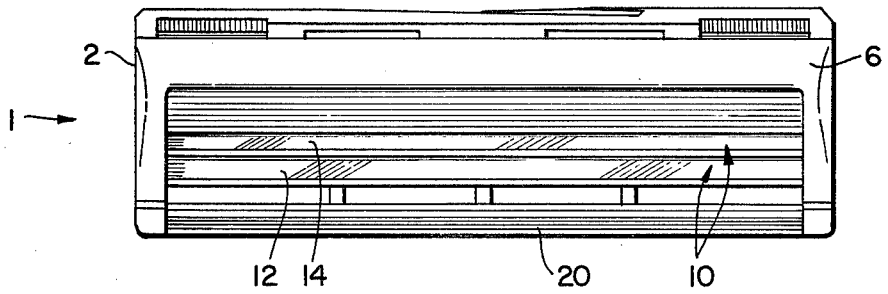
FIG. 2 is a top plan view of the blade assembly.
Figure 3:
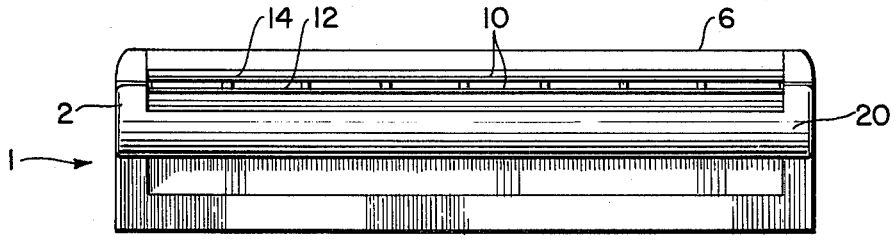
FIG. 3 is a front elevational view of the blade assembly.
Figure 4:
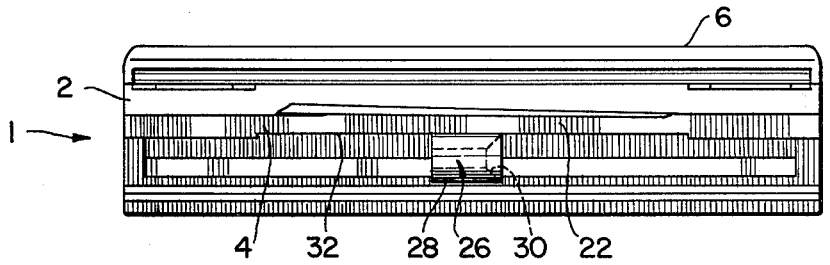
FIG. 4 is a back elevational view of the blade assembly.
Figure 5:
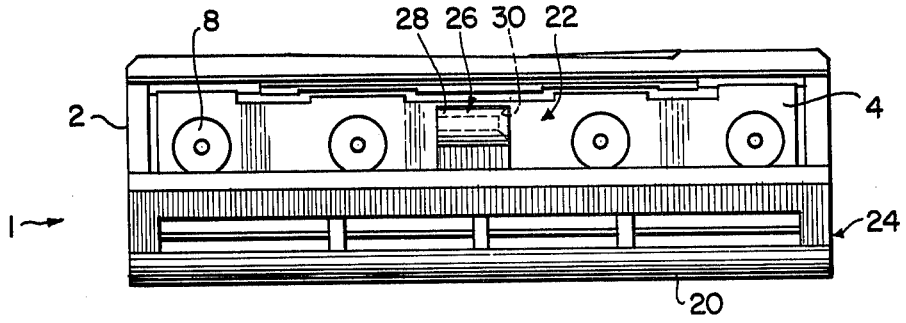
FIG. 5 is a bottom view of the blade assembly.

Referring to the drawings, it will be seen that an illustrative razor blade assembly 1 comprises a body 2, which may be of molded plastic. The body 2 may comprise a platform portion 4 to which is fixed a cap portion 6, as by rivet means 8. Permanently fixed between the platform and cap portions 4, 6 are blade means 10 which may, as illustrated, include first and second blades 12, 14 separated by a spacer means 16. Preferably, the rivet means 8 extend through the blades 12, 14 and spacer 16 to securely join the blade assembly components.

Connected to the platform portion 4 by means of a relatively thin molded web 18 is a guard portion 20. The web 18 is an integrally molded portion of the body portion which hingedly interconnects the platform portion 4 and the guard portion 20. Thus, a first portion 22 of the body 2 is pivotally joined, by way of the web 18, to a second portion 24 of the body.

Disposed on the first portion 22 of the body 2 is a first connecting means 26 by which the blade assembly may be pivotally connected to a razor handle, as will be further described hereinbelow. The first connecting means, as illustrated, comprises a projection 28 extending downwardly, as viewed in the drawings, and having therein an opening 30 for pivotally receiving a handle connecting means. The projection 28 is disposed centrally of the blade assembly, extending from an undersurface 32 of the platform portion 4.

Disposed on the second portion 24 of the body 2, is a second connecting means 34 by which the blade assembly may be fixedly connected to the razor handle, as will be further described hereinbelow. The second connecting means, as illustrated, comprise a pair of parallel elongated rails 36 extending lengthwise of the blade assembly, in known fashion. The rails 36 define opposed grooves 38 which comprise a blade assembly slide means and are adapted to slidingly receive a razor handle slide means.

Accordingly, the first portion 22 of the body 2 is adapted to be pivotally connected to the razor handle, while the second portion 24 is adapted to be fixedly connected to the razor handle, the first and second portions 22, 24 being pivotally joined to each other.

A razor handle 40 suitable for use with the illustrative blade assembly includes a grip portion 42 and a neck portion 44. Pivotally connected to the grip portion 42 is a lever 46 having at its upper end a dowel portion 48 adapted to engage the opening 30 of the blade assembly projection 28. Thus, the lever 46 comprises a handle first connecting means 50 adapted to engage the blade assembly first connecting means 26 to form a pivotal connection.

The razor handle neck portion 44 is provided with a pair of parallel elongated rails 52 adapted to slidingly engage the grooves 38 to fixedly interconnect the handle and the blade assembly. The rails 52 accordingly constitute a razor handle second connecting means 54 adapted to be fixedly connected to the blade assembly second connecting means 34.

The grip portion 42 of the handle 40 has anchored therein a leaf spring 54 which extends into, and is attached to, the neck portion 44. The neck portion 44 is connected to the grip portion 42 by the spring 54 and, upon flexing of the spring 54, is moveable relative to the grip portion.

The razor handle 40 may be connected to the blade assembly 1 by engaging the rails 52 with the grooves 38 and the dowel portion 48 with the projection 28, thereby effecting a first pivotal connection between the handle and the blade assembly body first portion 22, and effecting a second fixed connection between the handle and the blade assembly body second portion 24.

Figure 6:
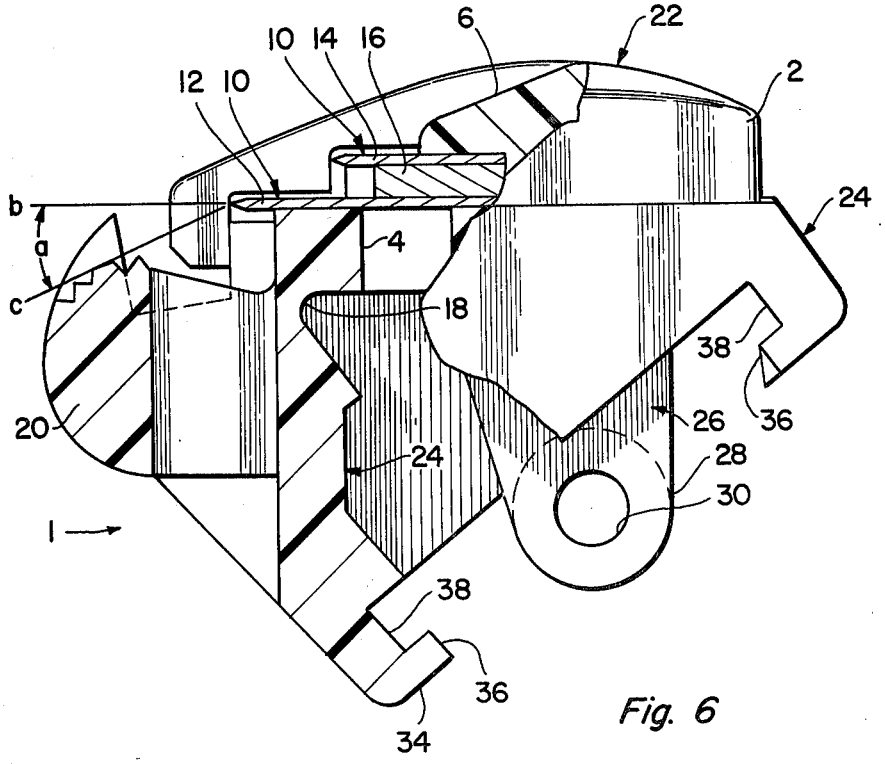
FIG. 6 is a side elevational view, in part cut away, of the blade assembly.
Figure 7:
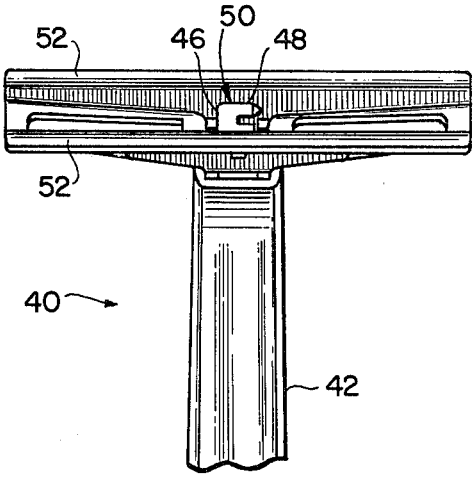
FIG. 7 is a front elevational view of the head portion of the razor handle.
Figure 8:
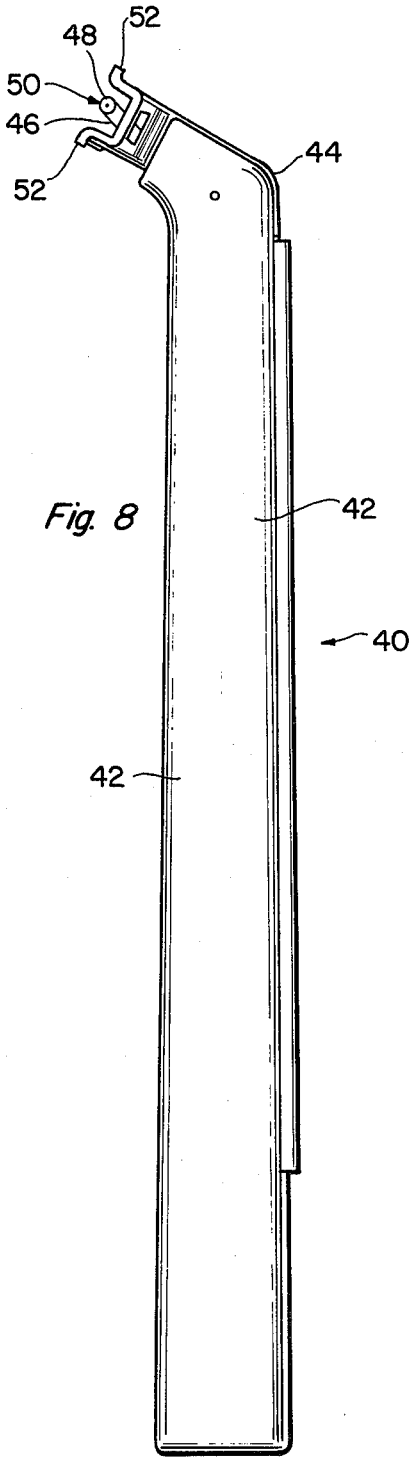
FIG. 8 is a side elevational view of the handle.
Figure 9:
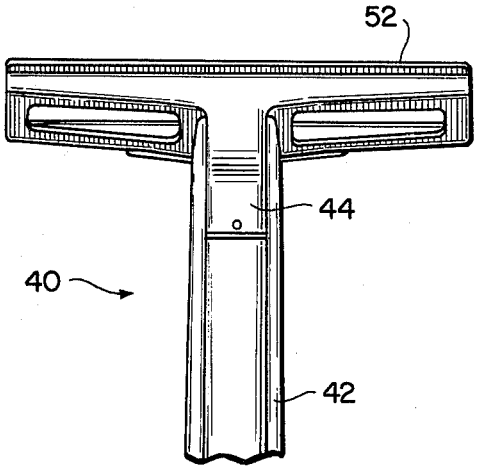
FIG. 9 is a back elevational view of the handle head portion.
Figure 10:
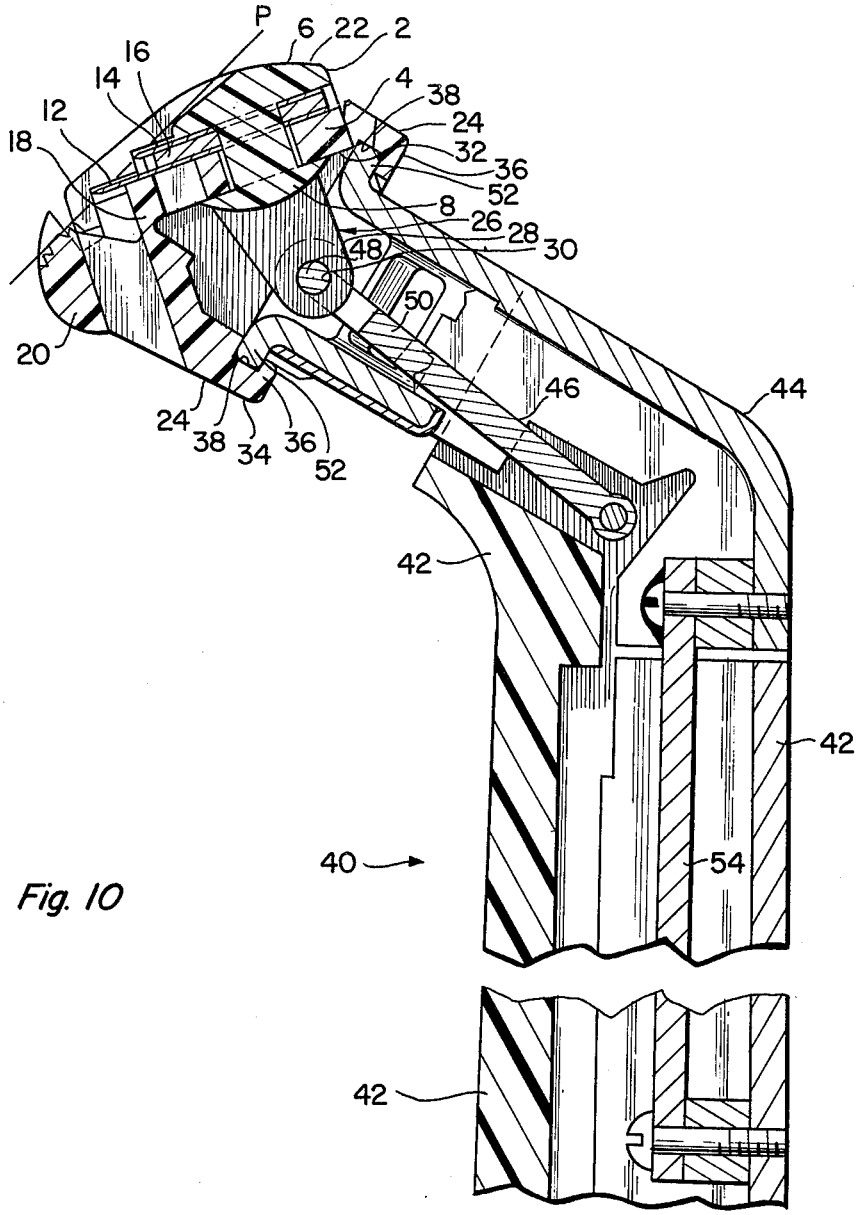
FIG. 10 is a side sectional view of the razor handle and blade assembly interconnected for a shaving operation, and shown in a first position.
Figure 11:
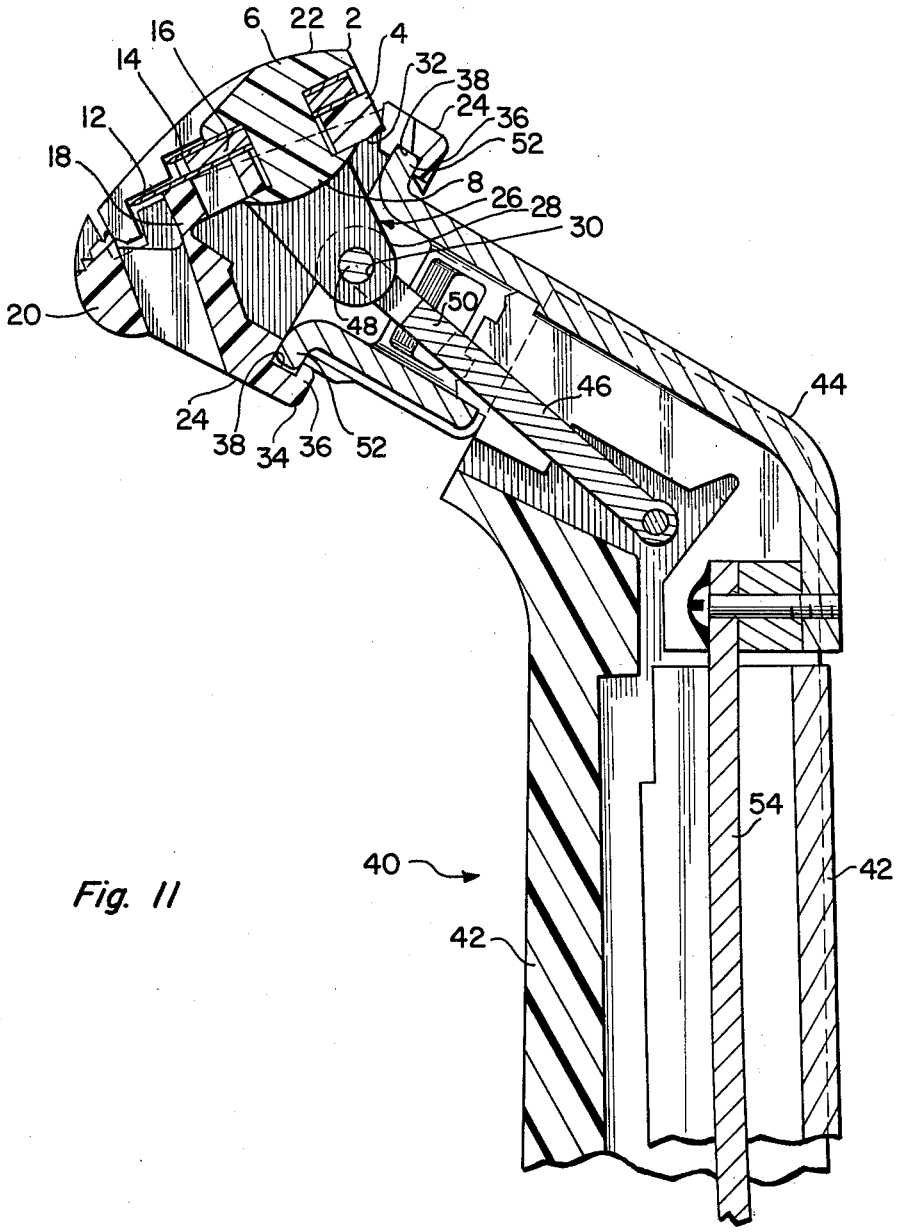
FIG. 11 is similar to FIG. 10, but showing the system in a second position.

In use, the blade assembly behaves in much the same manner as blade assemblies of the type fixedly and immovably connected to their handles, until a particular force level is exerted on the razor. When the blade assembly is urged by the operator against the surface being shaved with sufficient force to overcome the bias of the spring 54, the neck portion 44 moves to the right, as viewed in FIGS. 10 and 11, as, for example, from a first position as shown in FIG. 10 to a second position as shown in FIG. 11, permitting the blade assembly first portion 22 to pivot about the lever 46, which is pivotally anchored to the grip portion 42 of the handle. The blade assembly second portion 24 is fixedly connected to the rails 52 and therefore moves with the neck portion 44, causing pivotal movement between the first and second portions of the blade assembly. Such movement between the first and second portions of the blade assembly has the effect of relatively withdrawing the first blade rearwardly behind a plane P (FIG. 10) extending from the cutting edge of the second blade to a guard portion tangent point, and further, of decreasing the angle a (FIG. 6) formed by a first line b extending through the plane of the first blade 12 and a second line c extending from the cutting edge of the first blade to a tangent point on the guard portion. Thus, as excess pressure is applied by the operator, the "exposure" of the blades is decreased and the "blade tangent angle" is decreased.

"Exposure" and "blade tangent angle" are defined and discussed in U.S. Pat. No. 3,786,563, issued Jan. b 22, 1974 in the names of Francis W. Dorion, Jr., et al. "Blade tangent angle" is defined as the angle between the bisector of the included angle of the cutting edge (the plane of the blade if the cutting edge is symmetrical) and a line from the cutting edge tangent to the skin engaging surface immediately forward of that cutting edge (in this instance, the guard portion). "Exposure" is defined as the distance, measured perpendicularly to a reference plane defined by skin engaging surfaces immediately in front of and behind the cutting edge (the plane P), from the cutting edge to that plane, the exposure being considered positive when the cutting edge is located on the outer (skin) side of that plane and being considered negative when the cutting edge is further from the skin than that plane.

Thus, excessive pressure, which normally might endanger the operator, causes a marked decrease in the exposure of the first cutting edge and a marked decrease in the blade tangent angle, thereby rendering the system safer and much less likely to inflict harm on the operator. The more forceful the operator becomes, the safer the system becomes. The shaving geometry is varied inversely with the force of the blade assembly on the surface being shaved. The system, however, becomes force sensitive only after a specific force, or load level, is reached. Before such force level is reached, the shaving geometry of the cartridge is static and similar to the geometry of systems now in public use.

In a preferred embodiment, after the force level is reached, the blade assembly starts to automatically adjust the blade tangent angle of the first blade from approximately 26° to approximately 15°, and the exposure of the first blade from 0.0015 inch to −0.004 inch. When the razor is lifted from the surface being shaved, a force load is no longer exerted on the blade assembly and the shaving geometry reverts to its normal static geometry.

It is preferred that the threshold sensing force be about 50 grams. Thus, with forces up to 50 grams, the blade assembly geometry remains in its static condition, with forces exceeding 50 grams, the razor starts decreasing the blade assembly geometry (blade tangent angle and exposure).

It is to be understood that the present invention is by no means limited to the particular construction herein disclosed and/or shown in the drawings, but also comprises any modifications or equivalents within the scope of the disclosure.

Having thus described my invention, what I claim as new and desire to secure by Letters Patent of the United States is:

1. A shaving system comprising a handle and a blade assembly, the handle comprising first and second connecting means extending from an end thereof, said first handle connecting means being disposed within said second handle connecting means, the blade assembly comprising a first body portion having thereon a first blade assembly connecting means and a second body portion having thereon a second blade assembly connecting means, the first blade assembly connecting means being pivotally connected to the first handle connecting means, and the second blade assembly connecting means being fixedly connected to the second handle connecting means, said blade assembly first body portion being pivotally joined to said blade assembly second body portion, said second handle connecting means being movable in directions transverse to the axis of a grip portion of said handle.

2. A shaving system comprising a handle and a blade assembly, the handle comprising a grip portion, a neck portion attached to said grip portion, a first handle connecting means extending from said grip portion and disposed in said neck portion, and a second handle connecting means extending from said neck portion, the blade assembly comprising a body portion having blade means permanently fixed therein, a first blade assembly connecting means disposed on said body portion and engaged with said first handle connecting means to form a pivotal connection therebetween, and a second blade assembly connecting means disposed on said body portion and fixedly interconnected with said second handle connecting means, said second handle connecting means being movable in directions transverse to the axis of said grip portion of said handle.

3. The shaving system in accordance with claim 2 in which said first blade assembly connecting means is disposed on a first portion of said blade assembly body portion and said second blade assembly connecting means is disposed on a second portion of said blade assembly body portion, said first and second blade assembly body portions being pivotally joined to each other.

4. The shaving system in accordance with claim 2 in which said moveable second handle connecting means is spring biased and is moveable upon application of pressure sufficient to overcome the force exerted by said spring bias.

5. The shaving system in accordance with claim 3 in which said moveable second handle connecting means is spring biased and is moveable upon application of pressure sufficient to overcome the force exerted by said spring bias.

6. The shaving system in accordance with claim 5 in which movement of said second handle connecting means causes pivotal movement of said blade assembly about said first handle connecting means and pivotal movement between said first portion of said blade assembly body portion and said second portion of said blade assembly body portion, to reduce exposure and blade tangent angle of said system.

7. A shaving system comprising a blade assembly and a handle, the blade assembly comprising a platform, a cap, blade means permanently disposed between said platform and said cap, a guard disposed forwardly of said platform, web means interconnecting said guard and said platform, pivot connecting means extending from said assembly and engaged with complementary pivot connecting means on said handle, and assembly mounting means extending from said guard and interconnected with complementary mounting means on said handle, said handle mounting means being moveable in directions generally transverse to an axis of a grip portion of said handle, said web means facilitating pivotal movement between said platform and said guard upon movement of said handle mounting means.

8. A shaving system comprising a blade assembly and a handle, the blade assembly comprising a platform, a cap, blade means permanently disposed between said platform and said cap, a guard disposed forwardly of said platform, web means interconnecting said guard and said platform, pivot connecting means extending from said blade assembly and engaged with a first end of a rigid lever which is at its second end pivotally anchored to a grip portion of said handle, and assembly mounting means extending from said guard and interconnected with complementary mounting means on a neck portion of said handle, said neck portion being moveable on said grip portion in directions generally transverse to an axis of said grip portion, said web means facilitating pivotal movement between said platform and said guard upon movement of said neck portion relative to said grip portion.

9. The shaving system in accordance with claim 8 in which said neck portion is attached to a leaf spring anchored in said grip portion.

* * * * *